US007040997B2

(12) United States Patent
Rayburn

(10) Patent No.: US 7,040,997 B2
(45) Date of Patent: May 9, 2006

(54) GOLF PRACTICE SYSTEM

(76) Inventor: Charles Calvin Rayburn, 12716 Sandia Ridge Pl. NE., Albuquerque, NM (US) 87111

( * ) Notice: Subject to any disclaimer, the term of this patent is extended or adjusted under 35 U.S.C. 154(b) by 115 days.

(21) Appl. No.: 10/764,593

(22) Filed: Jan. 26, 2004

(65) Prior Publication Data

US 2005/0164798 A1 Jul. 28, 2005

Related U.S. Application Data

(60) Provisional application No. 60/446,303, filed on Feb. 11, 2003.

(51) Int. Cl.
*A63B 69/36* (2006.01)

(52) U.S. Cl. ..... 473/143; 473/138; 473/142

(58) Field of Classification Search ..... 473/138–149, 473/219–229; 273/DIG. 21
See application file for complete search history.

(56) References Cited

U.S. PATENT DOCUMENTS 1,528,739 A * 3/1925 Boyce ..... 473/147
1,967,776 A * 7/1934 Merritt ..... 473/143
1,976,405 A 10/1934 Le Witt
2,014,145 A 9/1935 Muth
2,080,653 A * 5/1937 Craft ..... 473/143
2,095,062 A 10/1937 Glancey
2,470,807 A 5/1949 Davis
3,181,366 A 5/1965 Collaro
3,656,759 A 4/1972 Hall
4,139,197 A 2/1979 Windall
4,660,835 A * 4/1987 Locurto ..... 473/147
4,927,154 A * 5/1990 Boyer et al. ..... 473/142
5,035,432 A * 7/1991 Lew ..... 473/140
5,056,790 A 10/1991 Russell
5,121,923 A 6/1992 D'Allura
5,156,400 A * 10/1992 Nemeth ..... 473/143
5,178,393 A 1/1993 Dennesen
5,885,164 A 3/1999 Wheatley
6,257,989 B1 7/2001 Tortola
6,343,996 B1 * 2/2002 Gasseling ..... 473/147
6,503,150 B1 * 1/2003 Holmes ..... 473/229
2001/0009870 A1 7/2001 Hammerquest
2003/0008718 A1 1/2003 Holmes

* cited by examiner

*Primary Examiner*—Nini F. Legesse

(57) ABSTRACT

An apparatus to be used to practice golf shots in limited space. A golf ball is tethered to one end of a line and the other end of the line is secured to a support which is calibrated to indicate the distance the ball would have traveled, when struck by a golf club, if the line were not secured to the support. The system includes an energy absorption device to control and limit the movement of the line through the system as the ball is struck.

4 Claims, 4 Drawing Sheets

Golf Progress Chart

Golfer_____ Date_____

Observations_____

Note: Before each shot reset the loop to START. After the shot, note the color band nearest the loop end with ring suspended. Place a dot on the chart at the intersection of the color band and club used. Note the corresponding yardage. Swing consistency is registered by the dot cluster.

GOLF PRACTICE SYSTEM

CROSS-REFERENCE TO RELATED APPLICATION

This application claims priority under 35USC119(e) based on Provisional Application No. 60/446,303, filed on Feb. 11, 2003

BACKGROUND OF THE INVENTION

Practice of golf has been limited to only a few venues and techniques. One common venue is a driving range which requires a significant amount of outdoor space and supply of balls. Driving ranges therefore are not always convenient for a golfer who has limited time and/or wants to practice frequently. Recently very expensive electronically controlled "simulated" driving ranges or courses have become available to replicate the results of actual golf swings. These venues are very expensive and usually not available to many golfers.

SUMMARY OF THE INVENTION

The invention provides a relatively low cost system for individuals to practice golf in the confines of their own yards.

The invention provides a system for practicing actual swings in limited space that uses energy absorption devices to dissipate the kinetic energy of the struck golf ball.

The invention also includes techniques and methods of charting the history and progress of their golf swings through use of a limited space "virtual" driving range.

The invention represents a very simple apparatus for practicing golf swings.

DETAILED DESCRIPTION OF THE INVENTION

Figure 1:
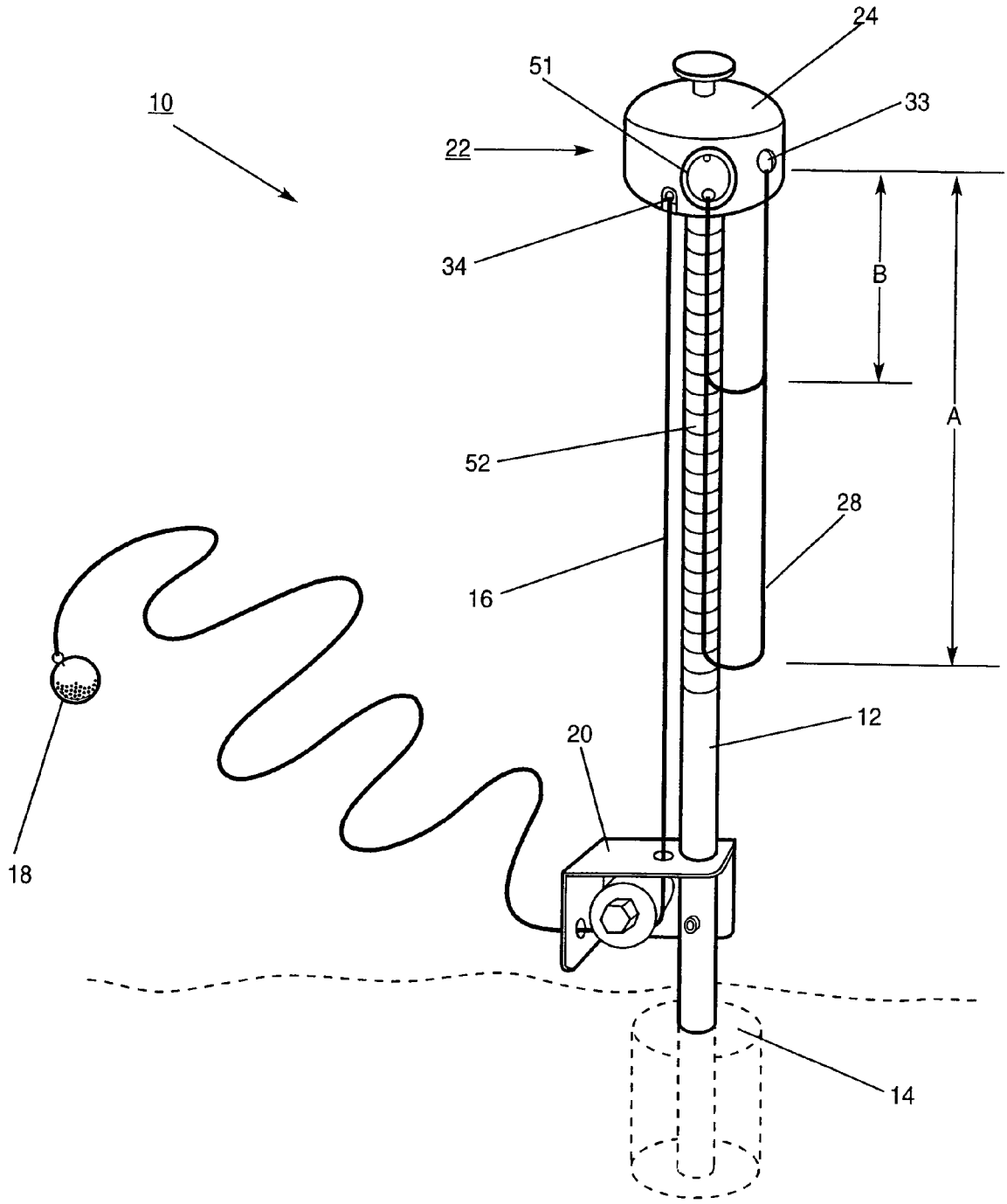
FIG. 1 is an elevational view of a preferred embodiment of the invention
Figure 2:
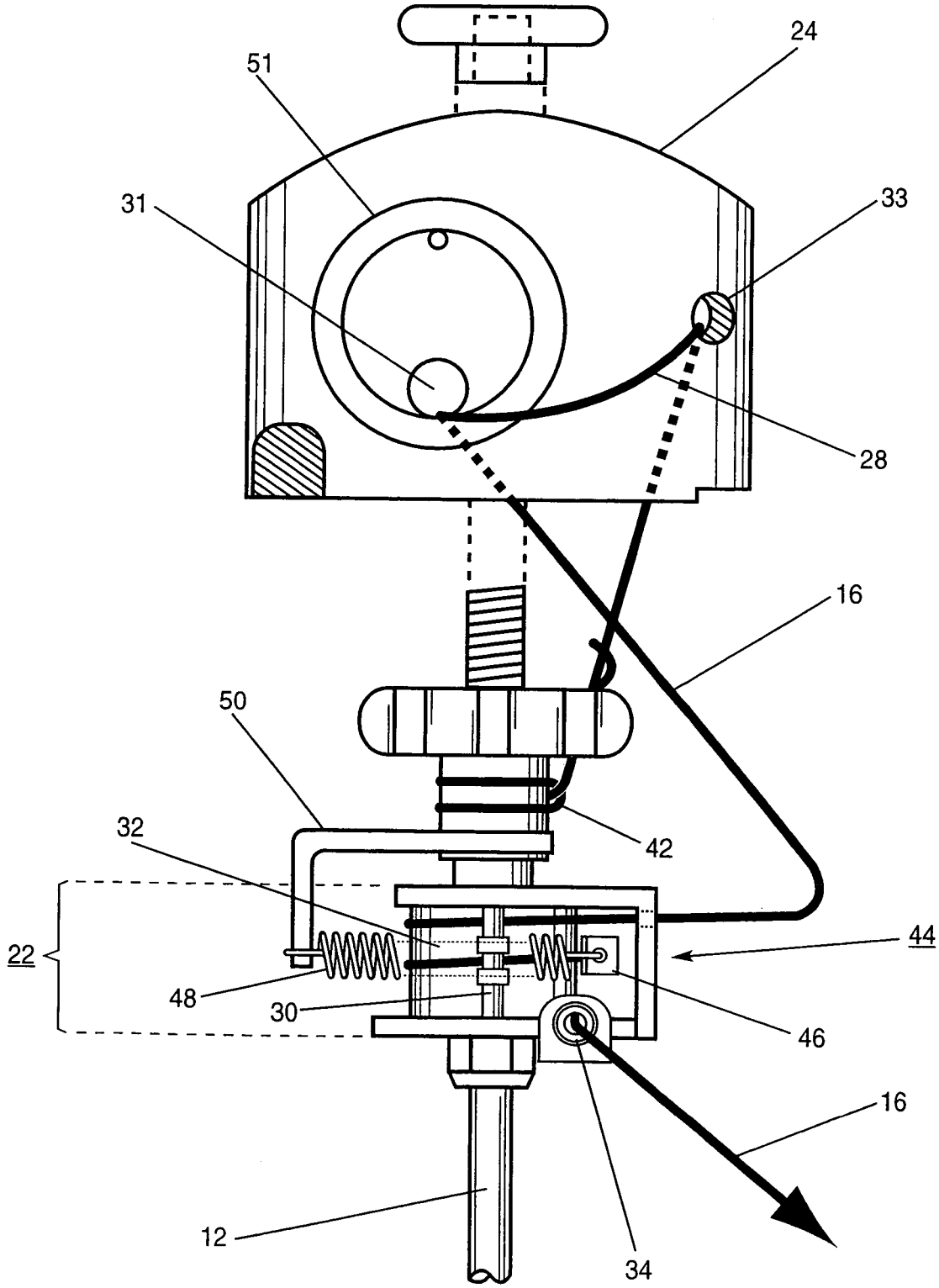
FIG. 2 is an enlarged schematic of the energy absorption device used in the system of FIG. 1.

Turning to the drawings and more particularly FIGS. 1 & 2, the system 10 and important elements are illustrated. A support pole 12 is positioned perpendicular to the ground and is preferably secured with concrete 14 to eliminate unwanted movement of the support. A line 16, preferably of braided high-density polyethylene and preferably of 10–15 yards is incorporated in the system. A standard golf ball 18 is firmly secured to a free end of the line. This securement may be accomplished by an eye screw (not shown). The line is fed through a line guide 20, located near the bottom of the pole 12, and fed upwards adjacent the pole to an energy absorption device 22. The line then is fed through a cap 24 and line reset ring 51 to an adjustable loop region 28 of the line to a fixed securement point 42 on the pole.

With specific attention to FIG. 2, the details of the important energy absorption device 22 and associated operational elements will be illustrated. The absorption device 22 consists of a cylinder 32 about which 2–3 pitches of the line are relatively tightly spirally wrapped and guided by dowels and spacers 30. The line 16 extends into the absorption device 22 through guide 34 and out of the absorption device through a guide hole 31 in guide cap 24 to a freely draped loop 28, through guide hole 33 and then to a fixed connection 42 on the support pole.

A spring-loaded friction control device 44 exerts a predetermined and controllable force on the external surface of the line wrapped about the cylinder. Drag arm 46, coil spring 48 and spring load control arm 50 provides the control for the frictional force on the line.

In operation, the adjustable loop 28 is pulled to be at its greatest length adjacent the scale 52. The ball is positioned on the ground or on a tee and struck by any club desired by the user as if the user were on a golf course. The struck ball thus has a significant amount of kinetic energy that must be absorbed since the object of the invention is to practice in a very confined and limited space.

The primary source for eliminating the kinetic energy is the heat generated by the frictional movement of the line moving around the cylinders. The line does move through the absorber and the limited amount of movement is reflected in the reduction of the length of the loop 28 from position "A" on the scale 52, prior to striking the ball to position "B" after striking the ball.

After each stroke of the ball the loop is returned to its original at rest position, preferably by assistance of a pull ring 51 associated with a top guide cap 24.

Figure 3:
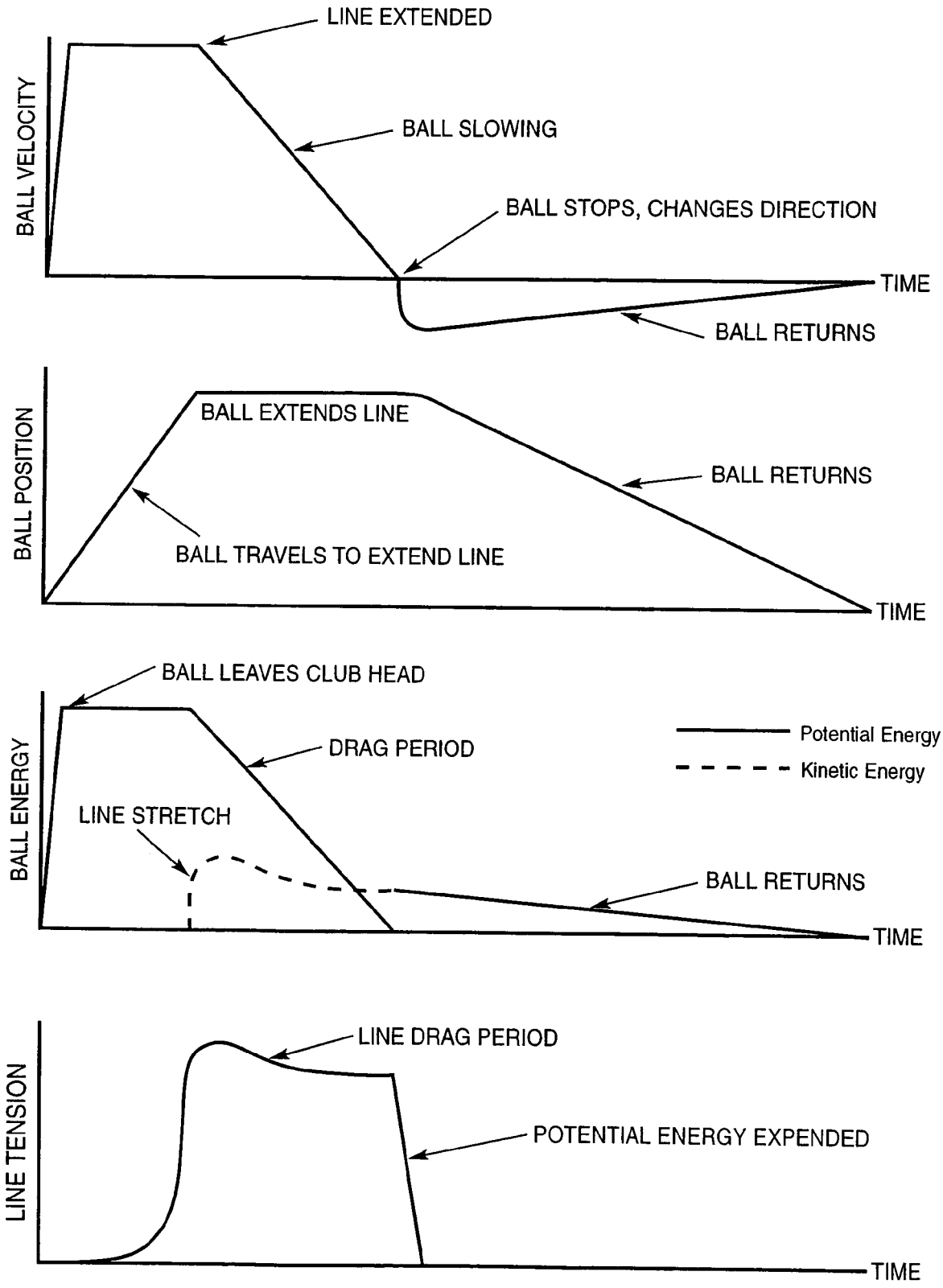
FIG. 3 is a series of charts illustrating the effects of various parameters over a cycle of time when using the invention.

The graphs of FIG. 3 illustrate the ball velocity, ball position, and ball energy and line tension all relative to time from striking the ball to the total dissipation of energy in the system.

Figure 4:
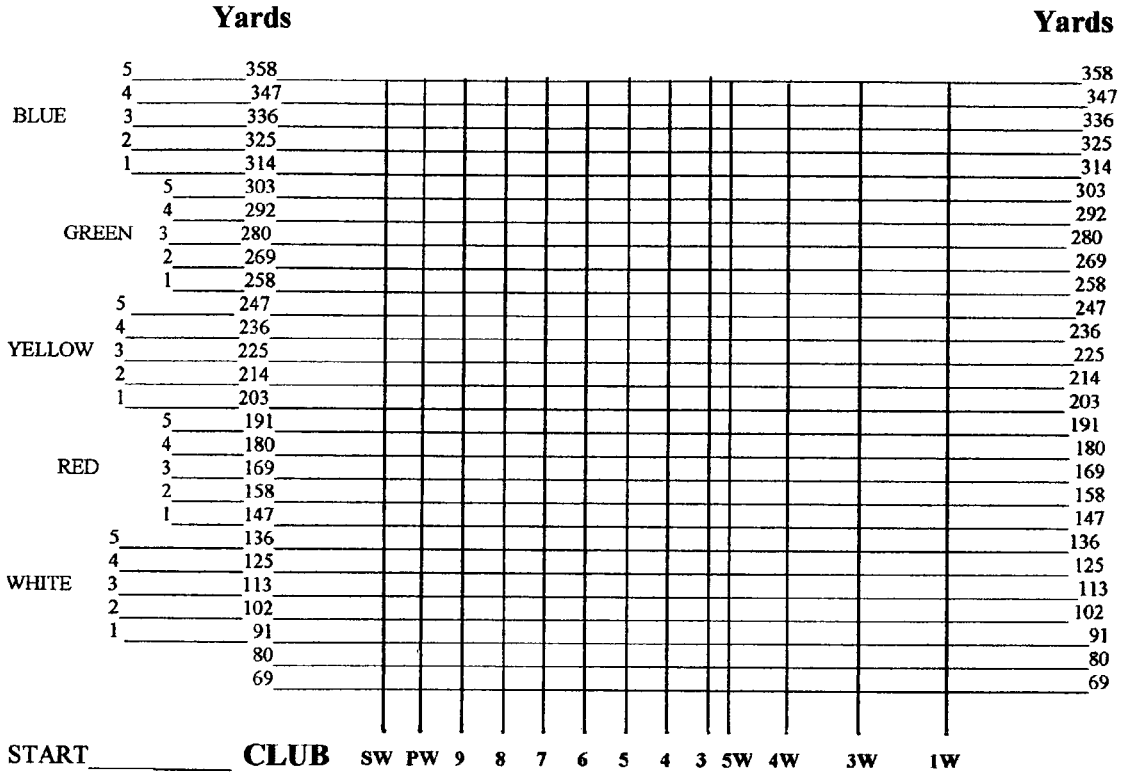
FIG. 4 is a sample progress chart that could be used for serious practitioners of the invention.

It is important to note that the line stretch resulting from the ball being struck provides energy for the ball to return to the vicinity of the striking The system of the invention can be used in a variety of manners depending on the seriousness of the user. A serious practitioner may want to chart his history of swings by clubs over a period of time. As shown on FIG. 4 a sample of such a chart can be used. Color codes may be used on the scale 52 depending on the competence of the golfer and the user then will use the appropriate color per the users competence.

Although the invention is described herein as a golf practice system it should be understood that the basic teachings of the invention could be used to practice other ball type games such as baseball.

What is claimed is:

1. A golf practice system including a support, a line, a ball attached to one end of the line, the line fixed at its other end to the support, the line extending around a generally cylindrical energy absorption device between the ball and the fixed end so that frictional movement of the line around the cylindrical device absorbs kinetic energy of the struck ball, the system further includes a scale that indicates the length of travel of a ball in free flight when the ball is struck and a loop of the line juxtaposed adjacent the scale so that a reduction in the length of the loop, upon striking of the ball, provides an indication of the distance the ball would have traveled if struck in an unrestrained environment.

2. The system of claim 1, wherein the energy absorption device dissipates most of the kinetic energy of the struck ball.

3. The system of claim 1, wherein the line is capable of stretching when the ball is struck, providing energy to return the ball to the vicinity of striking.

4. The system of claim 3, wherein the line is of polyethylene material.

* * * * *